United States Patent [19]

Pritchard

[11] Patent Number: 4,705,481

[45] Date of Patent: Nov. 10, 1987

[54] ELECTRICAL CONNECTION DEVICES FOR USE WITH FLAT CABLE

[75] Inventor: Philip N. W. Pritchard, Whitstable, England

[73] Assignee: Amphenol Corporation, Wallingford, Conn.

[21] Appl. No.: 777,397

[22] Filed: Sep. 19, 1985

[30] Foreign Application Priority Data

Sep. 26, 1984 [GB] United Kingdom ..... 8424281

[51] Int. Cl.[4] ..... H01R 4/24

[52] U.S. Cl. ..... 439/417

[58] Field of Search ..... 339/97 R, 97 P, 98, 339/99 R

[56] References Cited

U.S. PATENT DOCUMENTS

| | | | |
|---|---|---|---|
| 3,582,532 | 6/1971 | Plummer . | |
| 3,612,743 | 10/1971 | Angele et al. . | |
| 4,240,687 | 12/1980 | Bumnell et al. . | |
| 4,289,370 | 9/1981 | Storck . | |
| 4,302,065 | 11/1981 | Taylor | 339/99 R |
| 4,446,330 | 5/1984 | Nager, Jr. . | |
| 4,463,998 | 8/1984 | Reavis et al. . | |
| 4,479,692 | 10/1984 | Greenwood et al. | 339/99 R |
| 4,480,889 | 11/1984 | Greenwood | 339/99 R |
| 4,563,050 | 1/1986 | Greenwood et al. | 339/99 R |

FOREIGN PATENT DOCUMENTS

| | | |
|---|---|---|
| 0084413 | 1/1982 | European Pat. Off. . |
| 691802 | 5/1953 | United Kingdom . |
| 1258702 | 12/1971 | United Kingdom . |
| 1357186 | 6/1974 | United Kingdom . |
| 1543661 | 4/1979 | United Kingdom . |
| 2052181 | 1/1981 | United Kingdom . |
| 2052134 | 1/1981 | United Kingdom . |
| 2070320 | 9/1981 | United Kingdom . |
| 2143382 | 12/1983 | United Kingdom . |

OTHER PUBLICATIONS

Electrical Review, 1984, 214, pp. 19 and 21.
Electrical Review, 1965, 177, p. 278.

*Primary Examiner*—Joseph H. McGlynn
*Attorney, Agent, or Firm*—Bacon & Thomas

[57] ABSTRACT

A socket outlet 40 is mounted on a flat power distribution cable 10 by a pedestal 50 which includes a base unit 52, an upper clamp unit 54 secured to it, and a separator plate 56. The base unit 52 has insulation displacement contacts (IDCs) 76 mounted with screw terminals 72. The IDCs 76 connect the live and neutral cable conductors 12, 14 from below, while a pointed bolt 88 forms a contact from above with the earthing screen 26 of the cable, the plate 56 being located beneath the screen 26 to separate the cable components and stop the IDCs penetrating too far. The standard socket outlet 40 is connected to the screw terminals 72 and bolt 88 using short lengths of wire, but can be interchanged or replaced by a blanking plate. To this end bushes 104 are of standard size and spacing, and there are also bolts 116 of the same gauge and spacing adjacent to them for mounting the pedestal on a standard mounting box.

14 Claims, 4 Drawing Figures

ELECTRICAL CONNECTION DEVICES FOR USE WITH FLAT CABLE

BACKGROUND OF THE INVENTION

1. Field of the Invention

This invention relates to connection devices such as junction boxes and the like for use with flat cables for power distribution such as the type designed for under-carpet use.

2. Description of the Prior Art

A demand exists for a connection system which is simple and effective to use in situ and which is nevertheless adaptable to a variety of different circumstances.

European Patent Application No. 84413 describes an adapter for splicing or lapping into a flat cable, but that construction has various disadvantages. Notably it is necessary to cut back the top conductive screen of the cable, and the installation is therefore not easy. The adapter further includes a considerable number of special, and hence expensive, parts, particularly in relation to the conductive connection members. Furthermore, the system is not readily adaptable to different uses or configurations.

It would be desirable to provide a connection device for a flat cable that overcame these disadvantages.

SUMMARY OF THE INVENTION

In accordance with this invention, there is provided a connecting device for a flat cable, comprising a base member having a cable-receiving surface over which a flat cable is to be laid, an upper member for location over the cable-receiving surface of the base member, securing means for securing the upper and base members together, and an insulative separating plate for location between the upper and base members over the cable-receiving surface to pass transversely through a cable to separate conductive elements thereof.

This invention further provides a connecting device for a flat cable, comprising a base member upon which a flat cable is to be laid, insulation-displacement contact (IDC) means in the base member for contacting conductors in the cable, clamping means over the cable and secured to the base member to clamp the cable and force the IDC means into contact with the said conductors, and screw terminals connected to the IDC means for receiving and connecting to a conductor wire.

In addition, this invention provides a connecting device for a flat cable comprising a base member having a cable-receiving surface upon which the ends of two flat cables are to be laid, two sets of insulation-displacement contact (IDC) means spaced in the same plane in the base member, each set being for contacting the conductors in a respective one of the cables, clamping means over the cables and secured to the base member to clamp the cables and force the IDC means into contact with the conductors, and means for connecting corresponding ones of the two sets of IDC means so as to electrically connect the two cables together.

In further accordance with this invention, there is provided a connecting device for a flat cable, comprising a base member upon which the flat cable is to be laid, contact means in the base member for contacting conductors in the cable, and clamping means over the cable for retaining the cable on the base member, the clamping means being adapted to receive a separate interchangeable standard socket unit or a blanking plate, selectively.

Also in accordance with this invention, there is provided a connecting device for a flat cable, comprising a connection pedestal which comprises a base member having a cable-receiving surface over which a flat cable is to be laid, an upper member for location over the cable-receiving surface of the base member and providing an upper surface for receiving a standard socket outlet, and securing means for securing the upper and base members together, first coupling means on the pedestal for attaching a separate standard socket outlet and comprising two spaced threaded sockets at opposed ends of the socket-receiving surface, and second coupling means on the pedestal for mounting the pedestal onto a separate mounting box and comprising two bores at the same spacing as the sockets and each adjacent a respective one of the sockets for receiving threaded members of a gauge which would be appropriate to fit in the said sockets.

A preferred embodiment of the present invention comprises a pedestal on which can be mounted a standard socket outlet unit. The pedestal is formed by a base member across which the cable is laid, an upper clamping member secured to the base member, and an insulative separating plate. The separating plate is inserted between conductive elements of the cable, notably beneath the earthing screen and above the current-carrying conductors. Contact with the current-carrying conductors is made by means of respective insulation displacement contact (IDC) means on the base member, which are joined to respective screw terminals. The separating plate stops the IDC means penetrating too far. A further IDC means on the clamping member connects with the earthing screen. The socket outlet is connected up with short lengths of electric wire, familiar to the electrician.

The pedestal has bushes of a gauge and spacing appropriate to receive an outlet of standard type, and also has fasteners of like gauge and spacing adjacent to the bushes so as to be mounted on a standard mounting box. Alternatively, or additionally, the pedestal can be used as a junction box to join two flat cables, or as a transition box to join flat cable to conventional cable with round conductors.

DESCRIPTION OF THE PREFERRED EMBODIMENTS

Figure 3:
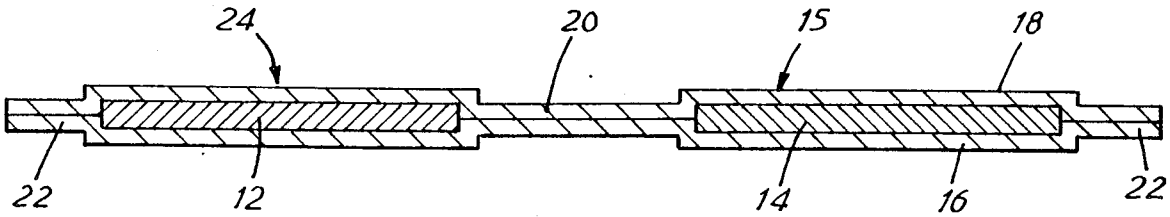
FIG. 3 is a section through the sealed inner conductor package forming part of the cable.
Figure 2:
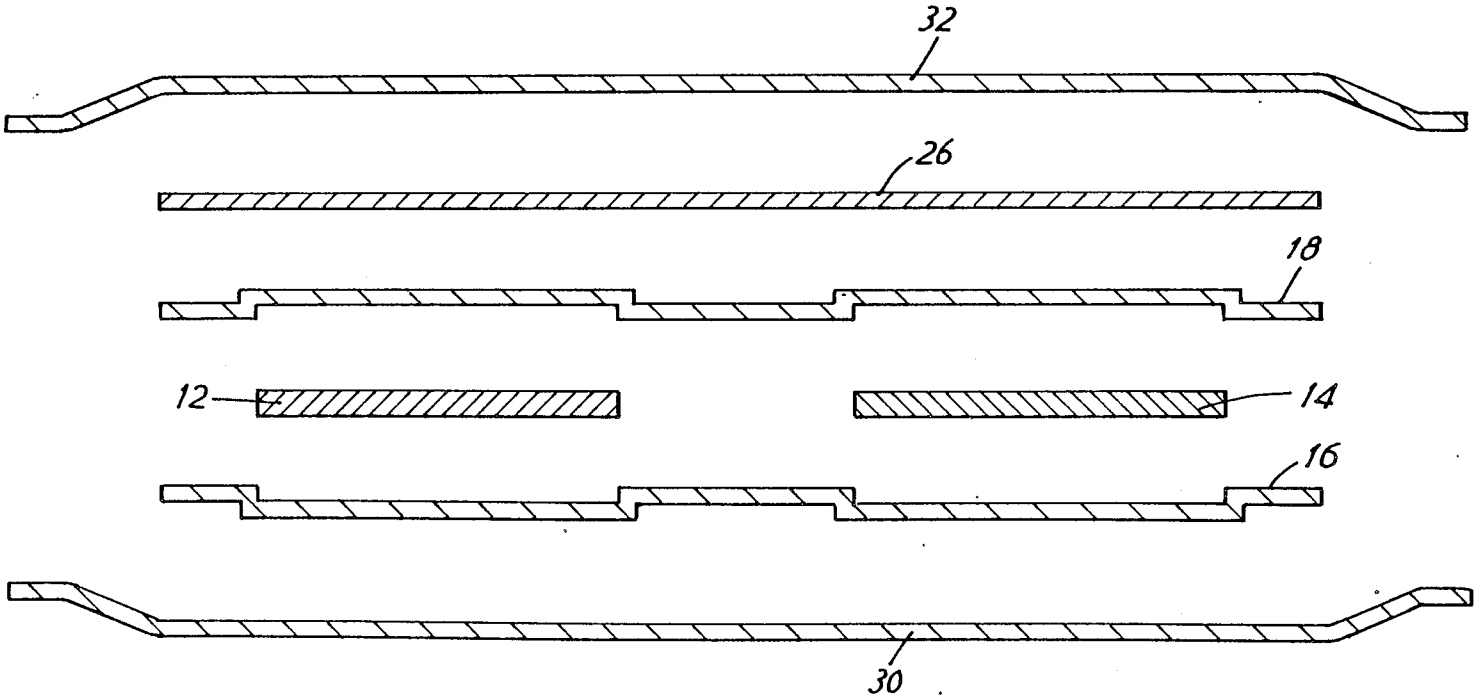
FIG. 2 is an exploded section showing the individual cable components.

The undercarpet cable 10 shown in the figures has a live conductor 12 and a neutral conductor 14. For use on 240 volts with a 30 amp current rating, these conductors are preferably of copper strip about 0.25 mm thick and about 20 mm wide. The thickness and width of the conductors for a 120 volt system may of course vary. These conductors 12, 14 are sandwiched between two flat films or strips 16, 18 which form an inner insulation sheath 15 and are about 60–65 mm wide. The strips 16, 18 are each conveniently a lamination of a polyester layer of about 0.06 mm thickness on the outer side away from the conductors, a fire retardant vinyl layer also of about 0.1 mm, and a heat-sealable adhesive layer on the innermost side. The total thickness of each strip 16, 18 is about 0.15 mm. The conductors 12, 14 are placed side by side on the lower strip 16 with a space of the order of 10 mm between them, and the upper strip 18 is then applied. The composite is then passed through shaped heat-sealing rollers to cause the conductors to be fully bonded to the sheath, and the two layers of the sheath to be bonded to each other in the regions where there is no conductor. These regions comprise a central region 20 between the conductors, and edge regions 22 to either side of the conductors. The line and neutral conductors 12, 14 are in this way formed into a sealed insulated inner package 24, as shown in FIG. 3.

To form the complete cable a solid copper earthing (or grounding) conductor 26 is now placed over the package 24. The earthing conductor has a width approximately equal to the width of the whole package 24 and acts as an electromagnetic screen, as well as assisting effective heat dissipation and providing a safety function in the event that the cable is penetrated by a foreign body (e.g., a nail). The earthing conductor 26 can normally be about half the thickness of the live and neutral conductors 12, 14. It should be noted that, for the reasons discussed below, the earthing conductor 26 should preferably not be bonded to the package 24 but is simply loosely laid on it. If the earthing screen is bonded to the conductor package, it should be sufficiently lightly bonded to be readily separable from it by hand.

An outer insulation jacket or sheath 28 is now formed around the combination of the package 24 and earthing conductor 26, by two flat strips 30, 32 which are of the same plastics lamination as the strips 16, 18, only about 20 mm wider. The edges 34 of the strips 30, 32 are then heat sealingly bonded to each other to form a sealed sheath. Preferably also the earthing conductor 26 is bonded to the upper strip 32 and the package 24 can be lightly bonded, for example at intermittent bands along the cable, to the lower strip 30. The completed cable is then typically about 80–85 mm wide and 1 mm thick. The sheath 28 has the effect of sealing the edge portion of the cable construction, and attaching the edge of the earthing conductor 26 to the edge of the package 24 to hold them together.

The outer sheath 28 preferably carries indications, e.g. by color coding, as to which is the top and which is the live conductor. If desired a second earthing conductor can be placed beneath the conductor package to provide further electrical and mechanical protection and also to enable the cable to be used either way up. This enables the cable to made to change direction by a simple fold.

The dimensions given above are for a 240 volts 30 amp cable with twin and earth conductors. For three-phase applications an additional two current-carrying conductors can be incorporated and the overall size varied to give the required performance characteristics.

The cable is installed underneath the carpet in an office or like environment. The cable is laid on the floor and covered by a steel tape which provides mechanical protection and which is secured to the floor by adhesive tape. The carpet can then be replaced over the cable.

Figure 4:
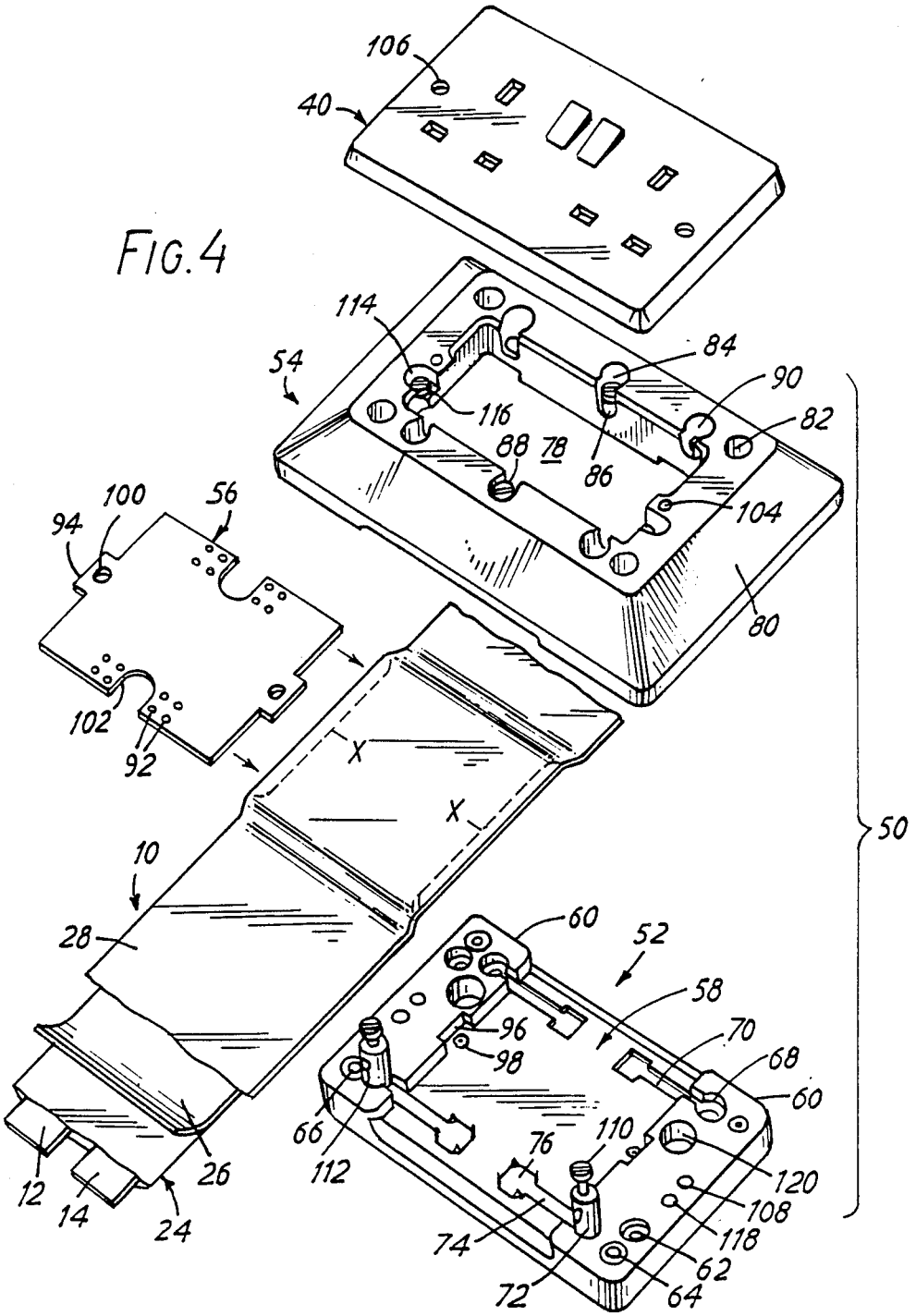
FIG. 4 is an exploded perspective view of an outlet socket and its pedestal mounted on the cable.

FIG. 4 illustrates the mounting of a socket outlet 40 on the cable 10. This is achieved by means of a box or pedestal 50 which is moulded of rigid plastics material and comprises a base unit 52 and an upper clamp unit 54, together with an insulation plate 56. The socket outlet 40 is a standard socket outlet appropriate to the type of plug connector to be received, and in the United Kingdom can be a twin socket outlet in accordance with the relevant British Standard (BS 1363) as designed for flush or surface wall mounting. No special socket outlet unit is required. The socket outlet will normally have screw connectors designed to receive an input power cable of conventional type.

The base unit 52 is of generally rectangular shape and has a broad transverse recess 58 forming a surface across which the flat cable 10 is laid. The end pillars 60 to either side of this recess 58 contain various moulded bores. These include two bores 62 near two opposed corners of the base unit for receiving fixing screws, if the pedestal is to be mounted on a wooden floor, or masonary or concrete fixing devices for other floors. At the four corners of the base unit there are bores 64 which each accommodate a threaded bush 66 to receive a bolt (not shown) which secures the clamp unit 54 to the base unit.

Four bores 68 are also provided which open towards the transverse recess 58 and communicate with shallow channels 70 in the base of the recess. At least two of these bores, one on each pillar 60, receive screw terminals 72 which are connected by a copper strip 74 to an insulation-displacement contact (IDC) 76 top form a unitary contact member. The contact 76 comprises a square plate the corners of which are bent upwards as shown to provide four sharp contact points, capable of penetrating the insulating sheath of the cable 10 to make good electrical contact with the live and neutral conductors 12 and 14.

The clamp unit 54 is designed to fit over and around the base unit 52 and with the assistance of the plate 56 to press the package 24 in the cable 10 down onto the IDC contacts 76 so that proper contact is made. The clamp unit 54 is of the same general shape as the base unit but has a central aperture 78 for receiving the rear of the socket outlet 40 and associated wiring, and also a larger flange 80 which bears against the floor (or may be relieved to receive the edge of the carpet). Four bores 82 accommodate the bolts (not shown) which are received in the threaded bushes 66 in the base unit. When the bolts are tightened the necessary clamping force is applied to the cable. Preferably the bolts are of the type which take a hexagonal Allen key so that they can provide a large clamping force. Bores 84 adjacent the aperture 78 in the center of the longer side of the clamp unit (the side which runs transverse to the cable) each accommodate a captive IDC terminal post 86. The lower end of the post 86 is conically pointed to form an insulation displacement contact which provides an earth termination to the earth conductor 26 in the cable 10. The upper end of the post 86 is provide with a screw terminal 88 similar to the screw terminals 72 for the live and neutral conductors. Further bores 90 are aligned above the four possible positions of the terminal posts 72, and open into the aperature 78.

The manner in which the cable is connected to the pedestal will now be described.

Figure 1:
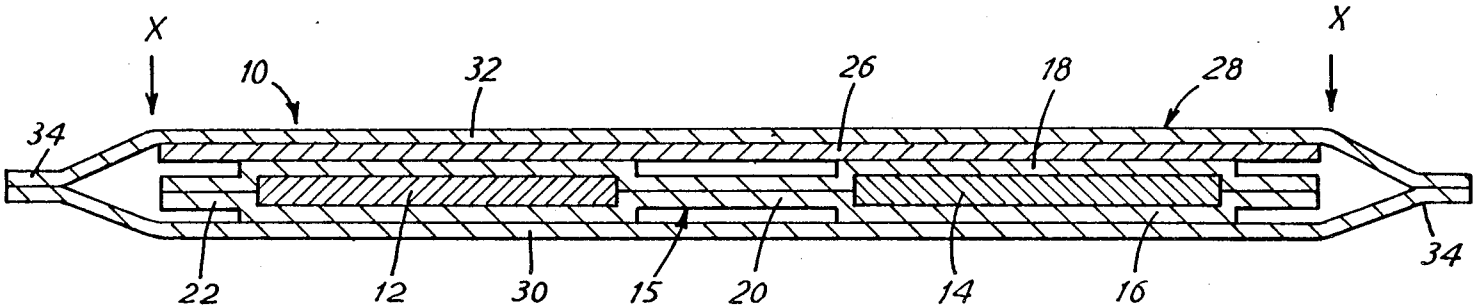
FIG. 1 shows a section through a twin-and-earth flat power cable designed for under-carpet use.

The cable is laid across the floor and the desired position for an outlet socket is chosen. A hole of appropriate size is made in the carpet. At this point the electrician has to gain access to the cable conductors. This he does with a sharp knife by slitting or cutting off the edges 34 of the outer sheath 28 in the region that will be lying over the recess 58. The line of the cut is shown at X in FIG. 1 and by the dashed lines X in FIG. 4. With the cable described, making these cuts in the right place is very easy. It will be recalled that the earthing conductor 26 is at least as wide as the conductor package 24. Thus all the electrician has to do is to feel for the edge of the earthing conductor 26, and to cut alongside it. In this way he removes the edge portions 34 which bond the two halves of the outer sheath together, but he is in no danger of violating the live and neutral conductor package 24.

The electrician may separate the lower layer 30 of the outer sheath, which is only relatively lightly bonded to the package 24, and pass it under the base unit 52 to form a dust shield under the pedestal.

It will also be recalled that the earthing conductor 26 was not bonded to the conductor package 24 or at least not firmly bonded. Thus over the length where the edges 34 are removed, the cable can easily be separated into two parts with a gap between them. The top part consists of the top outer insulating strip 32 and the earthing conductor 26, and the bottom part consists of the bottom outer insulating strip 30 and the conductor package 24, the latter containing the live and neutral conductors 12 and 14 in the inner insulating sheath 15.

Now the electrician takes the third element of the pedestal 50, namely, the insulating plate 56. This is of the same general shape as the recess 58 across which the cable lies. The electrician slides this plate between the two separated parts of the cable and places it over the recess 58. The clamp unit 54 is placed on top and the clamping bolts in bores 82 are tightened into bushes 66. The clamping force is sufficient to force the bottom part of the cable down onto the contacts 76 to cause the contact points to penetrate the insulation and make contact with the live and neutral conductors 12 and 14 respectively, and to cause the contact point of the terminal post 86 to penetrate the earth conductor 26.

To assist in this the plate 56 has bores or recesses 92 which are aligned with the points of the contacts 76. To maintain the alignment of the plate 56, the plate has rectangular projections 94 at either end which slide into corresponding recesses 96 in the inside edges of the pillars 60. The base plate 52 may optionally include threaded bushes 98 at this point, in which case the plate 56 has corresponding holes 100. A bolt can then be passed through each hole 100 into the bush 98 and tightened to hold the plate 56 and hence the bottom part of the cable in place for the subsequent assembly stages.

The plate 56 is of such a thickness that there can be no danger of the contacts 76 penetrating from the underside as far as the top surface of the plate to make contact with the earth, or the earth IDC penetrating from the upper side to make contact with the live and neutral conductors below. To assist in allowing penetration of the conductor the plate has cut-outs 102.

The plate 56 can have appropriate instructions printed on it to assist the electrician in installing the socket outlet correctly.

Now the pedestal is completed and it remains only to attach the standard socket outlet 40. For this purpose the clamp unit 54 has two threaded bushes 104 at the required spacing at either end of the aperture 78. Conventional fixing bolts (not shown) pass through holes 106 in the socket outlet 40 and engage in bushes 104. The base unit 52 has two bores 108 which receive the ends of these fixing bolts should they protrude through the clamp unit 54.

In use it is, of course, necessary to complete the electrical connections to the socket outlet 40 before it is bolted in place. The terminal posts 72 protrude through the bores 90 in the clamp unit 54, so that the screw terminals 110 are accessible from above and the wire-receiving transverse bores 112 in the terminal posts are open into the aperture 78. In the example illustrated in FIG. 4 there are two terminal posts 72, one for each of the live and neutral conductors 12 and 14, and this will be the usual arrangement. A short length of insulated wire is then run from the terminal posts to the terminals on the rear of the standard twin switched socket 40. The earth connection is provided by a further length of wire between the respective terminal on the socket 40 and the screw terminal 88 at the top of terminal post 86 which makes direct contact with the earth conductor 26 in the cable. This type of connection is familiar to electricians and so is easy to make and most unlikely to be made incorrectly. As the pedestal 50 provides a standard fixing for the socket 40, alternative types of outlet can be used which have the same fixing parameters.

An advantage of the system illustrated is that if it is desired to remove the socket outlet from the position in which it is installed, this can be done without difficulty. The only damage done to the cable is to make small pinpricks in the insulation.

The same basic pedestal can be used in other different configurations. Different types of outlet socket can be mounted by using a spacer or adaptor moulding mounted on the clamp unit, or alternatively by incorporating the necessary adaptation in the shape of the clamp unit. The pedestal illustrated can also be used to join two lengths of cable 10, or as a transition box to join a length of conventional supply cable to the flat cable 10, as will now be described.

When used a junction box to join two lengths of flat cable, the pedestal includes four of the terminal posts 72 and associated insulation displacement contacts 76 spaced in the recess 58. The cable lengths are cut so as to terminate in the middle of the recess, and thus the contacts 76 at one end of the recess 58 will embed in one of the cable ends and those at the other end of the recess in the other cable end. The live and neutral connections are completed by short lengths of wire between the terminal posts 72, and the earth connections by a short length of wire between terminal posts 86. A socket 40 can be mounted on such a junction box or, if no socket is required at that point, a conventional plain blanking plate can be used. This system is particularly useful in that it enables an existing cable length terminating at a socket outlet to be extended by an additional length of cable without the need to replace the existing length with a longer length.

A modification of the junction box can be used to connect different cable runs at an angle. For example, a square box can be constructed to join cables at right angles and basically triangular boxes to join cables at other angles.

Finally, the pedestal 50 can be used as a transition box to connect the cable to a conventional 2.5 $mm^2$ twin and earth power cable, or similar, such as used on a ring main. In this case the pedestal is mounted over a existing type of recessed conduit box secured to the wall near the floor or to the floor itself. The clamp unit 54 has two extra recessed bores 114 (next to the bushes 104 and at the same spacing as them) which receive fixing bolts 116 of the same gauge as used in the bores 106 to mount the socket 40. These fixing bolts pass through bores 118 in the base unit and engage in the threaded holes or bosses in the conduit box (not shown). Thus the cable 10 is first mounted in the pedestal in the manner previously described, and the bolts 116 tightened up. The incoming power cable is then passed through a hole 120 in the base unit 52 and terminated on the terminal posts 72 for the live and neutral conductors and the bolt 88 for the earth conductor. Two holes 120 are provided so that two cables can be accommodated if ring main wiring is used to supply the conduit box. Finally either a socket 40 or a blanking plate can be mounted on the pedestal, as described above.

In this way the cable 10 can for example be connected to an existing wall mounted socket outlet, running down the wall from the socket and then along the floor under the carpet for as far as is desired. Sockets can be mounted on the cable wherever required along its length. The conductors 12, 14 in the cable are connected to the live and neutral supply, while the supply earth is connected solely to the earthing conductor screen 26. As there is no need with this cable construction for the conductor package to include an earth conductor, the overall cable width is sufficiently narrow to fit conveniently under a standard socket outlet unit.

Because the bolts 116 are not quite on the center line of the base unit (the bores 104 are in the way), the pedestal 50 and hence the socket 40 sits slightly asymmetrically on the conduit box. This does not matter because the pedestal is wider than the socket outlet normally used on the conduit box. While the bolts 116 are shown as holding the whole assembly 50 on the conduit box, in an alternative arrangement they could secure only the base unit 52 to the conduit box, the bores 118 being suitably countersunk to receive the heads of the bolts.

The cable and pedestal cooperate to provide an extremely effective power distribution system for under-carpet use. The cable provides the current-carrying conductors with two layers of insulation, but is constructed so as to facilitate terminating and joining the cable. The pedestal takes advantage of the cable construction and provides a simple but adaptable mounting which can be used in various configurations, namely with standard outlet sockets, or as an junction box to join two like cable lengths, or as a transition box to join the flat cable to a conventional cable, or to perform two of these functions simultaneously.

I claim:

1. A connection device for a flat cable, comprising a base member having a cable-receiving surface over which a flat cable is to be laid, an upper member for location over the cable-receiving surface of the base member, securing means for securing the upper and base members together, and an insulative separating plate for location between the upper and base members over the cable-receiving surface to pass transversely through a cable to separate conductive elements thereof.

2. A device according to claim 1 including an insulation displacement contact means provided on the upper member for contacting a conductor in the cable.

3. A device according to claim 1, including insulation displacement contact (IDC) means in the base member for contacting conductors in the cable at a point under the insulative separating plate.

4. A device according to claim 3 including screw terminals connected to the IDC means for receiving and connecting to a conductor wire.

5. A connection device for a flat cable, comprising a base member upon which a flat cable is to be laid, insulation-displacement contact (IDC) means in the base member for contacting conductors in the cable, clamping means over the cable and secured to the base member to clamp the cable and force the IDC means into contact with the said conductors, and screw terminals connected to the IDC means for receiving and connecting to a conductor wire.

6. A connection device according to claim 5, including a further IDC means provided on the clamping means for contacting a conductor in the cable from the other side of the cable than the first said IDC means.

7. A connection device according to claim 5, in which the screw terminals and the respective IDC means are joined together by a conductor portion to provide a unitary contact member.

8. A connection device according to claim 7, in which the screw terminals protrude through bores in the clamping means to be accessible from the upper surface thereof.

9. A connection device for a flat cable comprising a base member having a cable-receiving surface upon which the ends of two flat cables are to be laid, two sets of insulation-displacement contact (IDC) means spaced in the same plane in the base member, each set being for contacting the conductors in a respective one of the cables, clamping means over the cables and secured to the base member to clamp the cables and force the IDC means into contact with the conductors, and means for connecting corresponding ones of the two sets of IDC means so as to electrically connect the two cables together.

10. A connection device according to claim 9, in which the connecting means comprises screw terminals connected to each IDC means, and wires connecting the respective screw terminals.

11. A connection device according to claim 10, including an insulative separating plate for location between the base member and the clamping means over the cable receiving surface to pass transversely through the cables to separate conductive elements thereof.

12. A connection device for a flat cable, comprising a base member upon which the flat cable is to be laid, contact means in the base member for contacting conductors in the cable, and clamping means over the cable for retaining the cable on the base member, the clamping means being adapted to receive a separate interchangeable standard socket unit or a blanking plate, selectively.

13. A connection device for a flat cable, comprising a connection pedestal which comprises a base member having a cable-receiving surface over which a flat cable is to be laid, an upper member for location over the cable-receiving surface of the base member and providing an upper surface for receiving a standard socket outlet, and securing means for securing the upper and base members together, first coupling means on the pedestal for attaching a separate standard socket outlet and comprising two spaced threaded sockets at opposed ends of the socket-receiving surface, and second coupling means on the pedestal for mounting the pedestal onto a separate mounting box and comprising two bores at the same spacing as the sockets and each adjacent a respective one of the sockets for receiving threaded members of a gauge which would be appropriate to fit in the said sockets.

14. A connection device for a flat cable, said cable comprising at least two side-by-side current-carrying strip conductors, an insulating layer around the conductors to form them into a unitary conductor package, an earthing screen over the conductor package, and outer insulating means around at least the edges of the cable construction to hold the earthing screen and the conductor package together, the earthing screen being electrically insulated from all the conductors in the conductor package, and being only lightly bonded to the conductor package, said connection device comprising a base member having a cable-receiving surface over which a flat cable is to be laid, an upper member for location over the cable-receiving surface of the base member, securing means for securing the upper and base members together, and an insulative separating plate for location between the upper and base members over the cable-receiving surface to pass transversely through the cable to separate said earthing screen from said strip conductors, insulation displacement contact (IDC) means in the base member for contacting said strip conductors in said cable at a point under said insulative separating plate and insulation displacement contact means provided on the upper member for contacting said earthing screen in said cable.

* * * * *